United States Patent [19]

Creech et al.

[11] Patent Number: 5,057,196

[45] Date of Patent: Oct. 15, 1991

[54] METHOD OF FORMING PLATINUM-SILICON-ENRICHED DIFFUSED ALUMINIDE COATING ON A SUPERALLOY SUBSTRATE

[75] Inventors: George E. Creech, Indianapolis; Michael J. Barber, Martinsville, both of Ind.

[73] Assignee: General Motors COrporation, Detroit, Mich.

[21] Appl. No.: 628,030

[22] Filed: Dec. 17, 1990

[51] Int. Cl.[5] ..... C25D 13/04

[52] U.S. Cl. ..... 204/181.5; 428/652

[58] Field of Search ..... 204/181.5; 428/652

[56] References Cited

U.S. PATENT DOCUMENTS

| | | | |
|---|---|---|---|
| 3,494,748 | 2/1970 | Todd | 29/194 |
| 3,692,554 | 9/1972 | Bungardt et al. | 117/22 |
| 3,748,110 | 7/1973 | Hodshire et al. | 428/652 |
| 3,819,338 | 6/1974 | Bungardt et al. | 29/194 |
| 3,955,935 | 5/1976 | Shockley et al. | 204/181.5 |
| 4,084,025 | 4/1978 | Raieden, III | 204/181.5 |
| 4,439,470 | 3/1984 | Sievers | 427/252 |
| 4,530,885 | 7/1985 | Restall | 428/680 |
| 4,656,099 | 4/1987 | Sievers | 428/610 |
| 4,774,149 | 9/1988 | Fishman | 428/680 |

OTHER PUBLICATIONS

Wing et al., "The Protection of Gas Turbine Blades," *Aircraft Engineering*, Oct. 1981, pp. 15–21.

*Primary Examiner*—John Niebling
*Assistant Examiner*—Kishor Mayekaar
*Attorney, Agent, or Firm*—George A. Grove; Domenica N. S. Hartman

[57] ABSTRACT

A platinum-silicon powder is electrophoretically deposited on a nickel or cobalt base superalloy substrate. The deposited powder is heated to form a transient liquid phase on the substrate and initiate diffusion of Pt and Si into the substrate. An aluminum-chromium powder is then electrophoretically deposited on the Pt-Si enriched substrate and diffusion heat treated to form a corrosion- and oxidation-resistant Pt-Si enriched diffused aluminide coating on the substrate. The presence of both Pt and Si in the aluminide coating unexpectedly improves coating ductility as compared to a Pt-enriched diffused aluminide coating without Si on the same substrate material.

5 Claims, 1 Drawing Sheet

METHOD OF FORMING PLATINUM-SILICON-ENRICHED DIFFUSED ALUMINIDE COATING ON A SUPERALLOY SUBSTRATE

FIELD OF THE INVENTION

The invention relates to corrosion/oxidation resistant platinum-silicon-enriched diffused aluminide coatings for nickel and cobalt base superalloys and to methods for their formation on such superalloys.

BACKGROUND OF THE INVENTION

In the gas turbine engine industry, there continues to be a need for improved corrosion- and oxidation-resistant protective coatings for nickel-base and cobalt-base superalloy components, such as blades and vanes, operating in the turbine section of the gas turbine engine. The use of stronger superalloys that often have lower hot corrosion resistance, the desire to use lower grade fuels, the demand for longer life components that will increase the time between overhaul and the higher operating temperatures that exist or are proposed for updated derivative or new gas turbine engines underscore this continued need.

Diffused aluminide coatings have been used to protect superalloy components in the turbine section of gas turbine engines. In a typical example, an aluminide coating is formed by electrophoretically applying an aluminum-base powder to a superalloy substrate and heating to diffuse the aluminum into the substrate. Such coatings may include chromium or manganese to increase the hot corrosion/oxidation resistance thereof.

To this end, it is known to improve the hot corrosion-/oxidation resistance of simple diffused aluminide coatings by incorporating a noble metal, especially platinum, therein. Such platinum-enriched diffused aluminide coatings are now applied commercially to superalloy components by first electroplating a thin film of platinum onto a carefully cleaned superalloy substrate, applying an activated aluminum-bearing coating on the electroplated platinum coating and then heating the coated substrate at a temperature and for a time sufficient to form the platinum-enriched diffused aluminide coating on the superalloy substrate. Optionally, the platinum may be diffused into the substrate either prior to or after the application of the aluminum. The platinum forms an aluminide of $PtAl_2$ and remains concentrated toward the outer surface regions of the coating.

Modified versions of the basic platinum-enriched diffused aluminide coating have been developed. One version on nickel-based alloys includes a two phase microstructure of NiAl(Pt) and $PtAl_2$. Another version uses a fused salt technique to deposit the platinum layer followed by a high activity-low temperature aluminizing treatment. This latter coating includes a thick $Pt_2Al_3$ plus PtAl structured zone.

Platinum-enriched diffused aluminide coatings have been tested on nickel and cobalt base superalloys and have been found to exhibit better hot corrosion/ oxidation resistance than the unmodified, simple diffused aluminide coatings on the same substrates. However, the platinum-enriched diffused aluminide coatings have exhibited reduction in coating ductility and undesirable increase in ductile-to-brittle transition temperature (DBTT) as compared to the unmodified, simple diffused aluminide coatings.

It has been proposed to improve the hot corrosion-/oxidation resistance of diffused aluminide coatings by alloying the coating with silicon. In particular, the application of a high purity silicon slurry spray followed by a pack aluminizing treatment has been reported to improve the hot corrosion/ oxidation resistance of nickel-base superalloys. However, the addition of silicon to the diffused aluminide coating has also been reported to reduce the ductility of the coating.

It is an object of the present invention to provide a method for applying a hot corrosion- and oxidation-resistant platinum-silicon-enriched diffused aluminide coating to nickel and cobalt base superalloy substrates in such a manner as to reduce the overall cost of coating application. It is another object of the present invention to increase the ductility of a platinum-enriched diffused aluminide coating at elevated temperatures without compromising hot corrosion and oxidation resistance by the inclusion of both platinum and silicon in the coating.

SUMMARY OF THE INVENTION

The present invention contemplates a method of forming a hot corrosion- and oxidation-resistant platinum-silicon-enriched diffused aluminide coating of improved ductility on a nickel or cobalt base superalloy substrate, comprising the steps of (a) electrophoretically depositing onto the substrate a platinum-silicon powder comprising about 3 percent to about 50 percent by weight silicon and the balance essentially platinum, (b) heating the deposited platinum-silicon powder at a temperature sufficient to melt the powder into a transient liquid phase in order to initiate diffusion of platinum and silicon into the substrate, (c) electrophoretically depositing an aluminum-bearing mixture or prealloyed powder onto the platinum and silicon-enriched substrate, and (d) heating the deposited aluminum-bearing powder at a temperature and for a time sufficient to form a platinum and silicon-enriched diffused aluminide coating which exhibits hot corrosion and oxidation resistance generally comparable to that of MCrAlY overlay coatings and which also exhibits a surprising and unexpected improvement in coating ductility at elevated temperatures, such as 1000° to 1400° F., as compared to the ductility of conventionally applied platinum-enriched diffused aluminide coatings without silicon formed on the same substrate material.

The present invention also contemplates a hot corrosion- and oxidation-resistant article comprising a nickel or cobalt superalloy substrate having a platinum and silicon-enriched diffused aluminide coating formed thereon and exhibiting a coating ductility at elevated temperatures greater than a conventionally applied platinum-enriched diffused aluminide coating (without silicon) on the same substrate material.

DETAILED DESCRIPTION OF THE INVENTION

Figure 1:
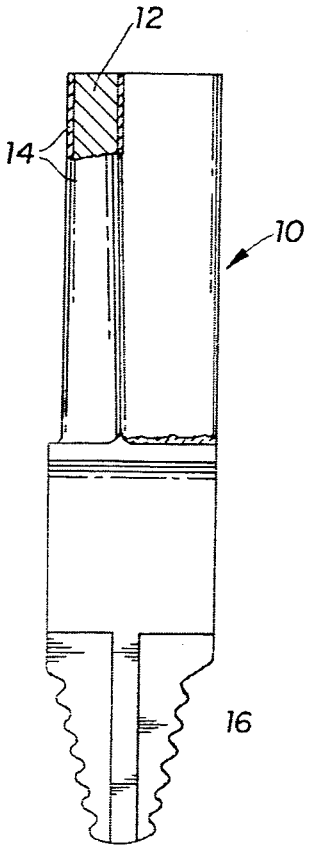
FIG. 1 is a schematic view (partly broken away and in section) of a typical turbine blade carrying a coating of the subject platinum-silicon-enriched diffused aluminide coating.

The subject coating method is particularly suitable for nickel- and cobalt-base superalloy castings such as, e.g., the type used to make blades and vanes for the turbine section of a gas turbine engine. FIG. 1 illustrates, for example, a turbine blade 10 formed of nickel- or cobalt-base superalloy body portion 12 provided with a diffused platinum-silicon-enriched aluminide coating layer 14 as described in this specification. For purposes of illustration, the thickness of coating layer 14 is exaggerated in FIG. 1, the actual thickness being of the order of a few thousandths of an inch. It is usually unnecessary to provide the subject corrosion/oxidation-enriched coating layer over the fastening portion 16 of the blade 10.

The method of the present invention involves producing a modified diffused aluminide coating containing platinum and silicon on nickel or cobalt base superalloy substrates by a sequential two-step electrophoretic deposition process with a diffusion heat treatment following each electrophoretic deposition step. Although not so limited, the method of the invention is especially useful in applying hot corrosion/oxidation resistant platinum and silicon-enriched diffused aluminide coatings having increased coating ductility to components, such as blades and vanes, for use in the turbine section of gas turbine engines.

In a preferred embodiment of the invention, platinum and silicon are applied in the form of an alloy powder to the surface of a nickel or cobalt base superalloy substrate (e.g., nickel-base superalloys such as IN738, IN792, Mar-M246, Mar-M247, etc., and cobalt-base superalloys such as Mar-M509, etc., which are known to those in the art) by a first electrophoretic deposition step. The alloy powder is prepared by mixing finely divided platinum powder with silicon powder of about one (1) micron particle size, compacting the mixed powders into a pellet and sintering the pellet in an argon atmosphere or other suitable protective atmosphere in a stepped heat treatment. One such heat treatment includes soaking (sintering) the pellet (1) at 1400° F. for 30 minutes, (2) at 1500° F. for 10 minutes, (3) at 1525° F. for 30 minutes, (4) at 1800° F. for 15 minutes and then (5) at 1900° F. for 30 minutes. The sintered pellet is reduced to approximately −325 mesh size by pulverizing in a steel cylinder and pestle and then ball milling the pulverized particulate in a vehicle (60 w/o isopropanol and 40 w/o nitromethane) for 12 to 30 hours under an inert argon atmosphere to produce a platinum-silicon alloy powder typically in the 1 to 10 micron particle size range. Such alloy powder may also be produced by other suitable methods known in the art, such as gas atomization.

Silicon is included in the alloy powder (as a melting point depressant) in an amount from about 3 percent to about 50 percent by weight silicon with the balance essentially platinum. A silicon content less than about 3 percent by weight is insufficient to provide an adequate amount of transient liquid phase in the subsequent diffusion heat treatment whereas a silicon content greater than about 50 percent by weight provides excessive transient liquid phase characterized by uneven coverage of the substrate. A preferred alloy powder composition includes about 10 percent by weight silicon with the balance essentially platinum. Moreover, as will be explained hereinbelow, the presence of silicon in combination with platinum in the diffused aluminide coating of the invention has been found to unexpectedly improve coating ductility as compared to conventionally applied platinum-enriched diffused aluminide coatings without silicon.

The platinum-silicon alloy powder (10 w/o Si - 90 w/o Pt) is electrophoretically deposited on the nickel or cobalt base superalloy substrate after first degreasing the substrate and then dry honing (cleaning) the substrate using 220 or 240 grit aluminum oxide particles.

The electrophoretic deposition step is carried out in the following electrophoretic bath:

Electrophoretic Bath Composition (a) solvent: 60 ±5% by weight isopropanol, 40 ±5% by weight nitromethane
(b) alloy powder: 20–25 grams alloy powder/liter of solvent
(c) zein: 2.0–3.0 grams zein/liter of solvent
(d) cobalt nitrate hexahydrate (CNH): 0.10–0.20 grams CNH/liter of solvent To effect electrophoretic deposition from the bath onto nickel or cobalt base superalloy substrates, the superalloy substrate is immersed in the electrophoretic bath and connected in a direct current electrical circuit as a cathode. A metallic strip (e.g., copper, stainless steel, nickel or other conductive material) is used as the anode and immersed in the bath adjacent the specimen (cathode). A current density of about 1–2 $mA/cm^2$ is applied between the substrate (cathode) and the anode for 1 to 3 minutes with the bath at room temperature. During this time, the platinum-silicon alloy powder coating is deposited as a uniform-thickness alloy powder deposit on the substrate. The weight of the coating deposited is typically about 10–20 $mg/cm^2$ of substrate surface, although coating weights from about 8 to 30 $mg/cm^2$ are suitable.

The coated substrate is then removed from the electrophoretic bath and air dried to evaporate any residual solvent.

The dried, coated substrate is then subjected to a diffusion heat treatment in a hydrogen, argon, vacuum or other suitable protective atmosphere furnace at a temperature of about 2000° F. for about 8 to about 30 minutes for nickel-base superalloy substrates or at a temperature of about 1900° F. for about 30 to 60 minutes for cobalt-base superalloy substrates. Following the diffusion heat treatment, the coated substrate is cooled to room temperature.

The temperature and time of the diffusion heat treatment are selected to melt the deposited platinum-silicon alloy powder coating and form a transient liquid phase evenly and uniformly covering the substrate surface to enable both platinum and silicon to diffuse into the substrate. Typically, the platinum-silicon-enriched diffusion zone on the substrate is about 1 to 1.5 mils in thickness and includes platinum and silicon primarily in solid solution in the diffusion zone.

As mentioned hereinabove, the composition of the platinum-silicon alloy powder (preferably 90 w/o Pt - 10 w/o Si) is selected to provide an optimum transient liquid phase for diffusion of platinum and silicon into the substrate during the first diffusion heat treatment.

Following the first diffusion heat treatment, the platinum-silicon-enriched superalloy substrate is cleaned by dry honing lightly with 220 or 240 grit aluminum oxide particulate.

After cleaning, the platinum-silicon-enriched superalloy substrate is coated with an aluminum-bearing deposit by a second electrophoretic deposition step. Preferably, for nickel-base superalloy substrates, a prealloyed powder comprising, e.g., either (1) 55 w/o aluminum and 45 w/o chromium or (2) 50 w/o aluminum, 35 w/o chromium and 15 w/o manganese is electrophoretically deposited on the substrate. For cobalt superalloy substrates, a prealloyed powder comprising, e.g., either (1) 65 w/o aluminum and 35 w/o chromium or (2) 70 w/o aluminum and 30 w/o chromium is preferably electrophoretically deposited on the substrate.

The electrophoretic deposition step is carried out under the same conditions set forth hereinabove for depositing the platinum-silicon alloy powder with, however, the aluminum-bearing powder substituted for the platinum-silicon alloy powder in the electrophoretic bath. The same quantity (e.g., 20–25 grams of aluminum-bearing alloy powder) is employed per liter of solvent to electrophoretically deposit the aluminum-bearing alloy powder onto the substrate.

The aluminum-bearing powder coating is electrophoretically deposited with coating weights in the range of about 15 to about 40 mg/cm$^2$ regardless of the composition of the aluminum-bearing coating and the composition of the substrate.

After the aluminum-bearing powder coating is electrophoretically deposited, the coated substrate is air dried to evaporate residual solvent.

Thereafter, the dried, aluminum-bearing powder coated substrate is subjected to a second diffusion heat treatment in a hydrogen, argon, vacuum or other suitable atmosphere furnace to form a platinum and silicon-enriched diffused aluminide coating on the substrate. For nickel-base superalloy substrates, the second diffusion heat treatment is carried out at about 1975° to 2100° F. for about 2 to 4 hours. For cobalt-base superalloy substrates, the second diffusion heat treatment is conducted at a temperature of about 1900° F. for about 2 to 5 hours.

Figure 2:
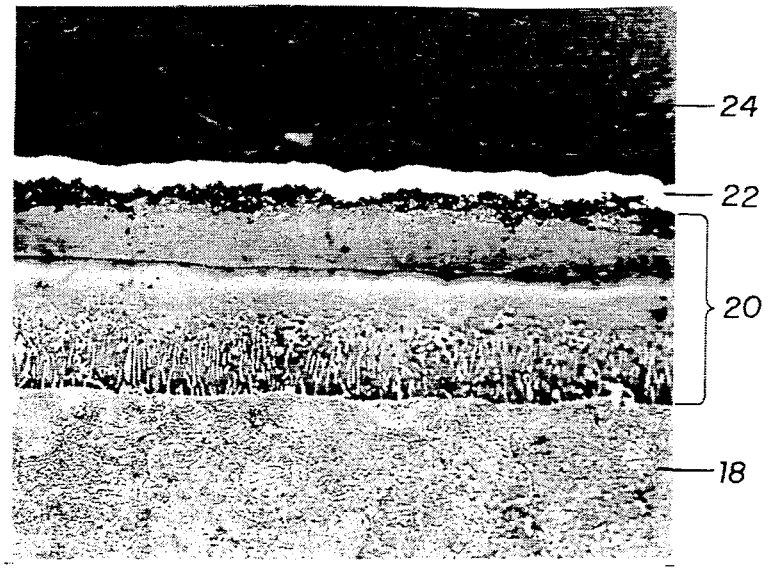
FIG. 2 is a photomicrograph at 500X magnification of a platinum-silicon-aluminide coating formed on a nickel-base (Mar-M247) superalloy substrate in accordance with the invention.

The diffused aluminide coating formed by the second diffusion heat treatment typically is about 2 to 3.5 mils in thickness and typically includes a two-phase platinum-rich outer zone as illustrated in FIG. 2 which comprises a photomicrograph of a Mar-M247 substrate 18 having a Pt-Si enriched diffused aluminide coating 20 formed thereon by the method of the invention (e.g., deposit 90 w/o Pt:10 w/o Si/ diffuse 2000° F. for 30 minutes/ deposit 55 w/o Al:45 w/o Cr/ diffuse 2000° F. for 2 hours) Numerals 22 and 24 respectively identify a nickel plate layer and a Bakelite layer used in the metallographic preparation of the sample for the photograph. The platinum content of the diffused aluminide coating produced in accordance with the invention is typically in the range from about 15 to about 35 w/o adjacent the outer surface of the coated substrate (i.e., about the same as conventionally applied Pt-enriched diffused aluminide coatings). The silicon content of the coating of the invention is typically in the range from about 0.5 to about 10 w/o adjacent the outer surface of the coated substrate.

Figure 3:
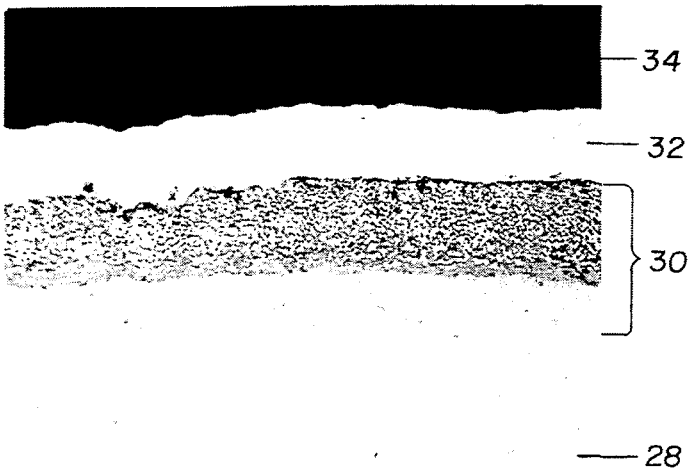
FIG. 3 is a photomicrograph at 500X magnification of a platinum-silicon-aluminide coating formed on a cobalt-base (Mar-M509) superalloy substrate.

FIG. 3 is a photomicrograph of a Mar-M509 cobalt-based substrate 28 having a platinum-silicon enriched diffused aluminide coating 30 formed by the method of this invention. Numerals 32 and 34 respectively identify nickel and Bakelite metallographic layers as described with respect to FIG. 2.

To illustrate the effectiveness of the invention in providing a hot corrosion- and oxidation-resistant diffused aluminide coating, 16 samples of Mar-M247 nickel-base superalloy in the form of ⅛ inch diameter pins were coated in the manner set forth hereinabove to form a platinum- and silicon-enriched diffused aluminide coating thereon. Four groups of four samples each were prepared to represent four variations of the subject invention and were tested for hot corrosion and oxidation resistance. The four groups of samples were made as follows:

Group A—deposit 90 w/o Pt:10 w/o Si (28–29 mg/cm$^2$)/ diffuse 2000° F. for 30 mins./ deposit 55 w/o Al:45 w/o Cr/ diffuse 2000° F. for 2 hrs./ coating thickness =3.4 mils Group B—deposit 90 w/o Pt:10 w/o Si (8.5–15.5 mg/cm$^2$)/ diffuse 2000° F. for 30 mins/ deposit 55 w/o Al:45 w/o Cr/ diffuse 2000° F. for 2 hrs./ coating thickness =2.9 mils Group C—deposit 90 w/o Pt:10 w/o Si:(18–21 mg/cm$^2$)/ diffuse 2000° F. for 8 mins./ deposit 55 w/o Al:45 w/o Cr/ diffuse 2000° F. for 2 hrs./ coating thickness =2.8 mils.

Group D—deposit 90 w/o Pt:10 w/o Si:(14–18 mg/cm$^2$)/ diffuse 2000° F. for 30 mins./ deposit 50 w/o Al:35 w/o Cr:15 w/o Mn/ diffuse 2000° F. for 2 hrs./ coating thickness =2.4 mils All four groups of coated samples exhibited enhanced hot corrosion resistance in a low velocity, atmospheric burner rig test designed to duplicate the known Type I corrosion test (high temperature, hot corrosion conditions). The test was performed at 1650° F. with No. 2 diesel fuel doped with 1 percent by weight sulfur. ASTM grade synthetic sea salt solution (10 ppm) was ingested into the combustion zone to produce an especially aggressive corrosive environment. In this test, all four groups of samples made in accordance with this invention exhibited at least four to six times the coating life of a simple, unmodified aluminide coated Mar-M247 sample (coating thickness of 1.8 mils) when compared on an hours per mil coating thickness basis. Moreover, this test suggested a coating life for the coated samples of the invention comparable to that of the more expensive CoCrAlY(26 w/o Cr-9 w/o Al) overlay coating (coating thickness of 2.9 mils) which were also tested on the same substrate material (Mar-M247). For example, the typical corrosion penetration depth of the coating formed in accordance with the invention after 1000 hours in the test was comparable to that experienced by a vendor-produced CoCrAlY overlay coating (coating thickness of 2.9 mils) on the same substrate material. Also, the coating life of the four groups of samples of the invention was comparable to that of a conventionally applied (Pt electroplate/ aluminized) platinum-enriched diffused aluminide coating (coating thickness of 3.0 mils) on the same substrate material.

Static oxidation testing at 1800°, 2000° and 2150° F. for up to 1000 hours in air of additional samples of the invention (e.g., deposit 90 w/o Pt:10 w/o Si:(24–29 mg/cm$^2$)/ diffuse 2000° F. for 30 mins./ deposit 55 w/o Al:45 w/o Cr/ diffuse 2000° F. for 2 hrs/ coating thickness =2.7 mils) was conducted. These samples exhibited oxidation resistance approximately equivalent to that of a conventional platinum-enriched diffused aluminide coated sample (coating thickness of 2.7 mils) tested on the same substrate material (Mar-M247) and approximately equivalent to that of the aforementioned CoCrAlY overlay coated sample (coating thickness of 3.1 mils) tested on the same substrate material. The coatings of the invention exhibited better diffusional stability in the oxidation tests than the CoCrAlY overlay coating.

Coating ductility tests were also conducted. These tests were conducted on a standard tensile test machine with acoustic monitoring of strain-to-first cracking of the coating. Fluorescent penetrant inspection was used to verify coating cracks. The higher the percent elongation to produce a coating crack, the more ductile the coating is at that temperature. For the test data presented below in Table I, the 1 and 2 percent elongation values indicate that the coating has begun to deform more or less at the same rate as the substrate. The temperature at which this occurs is designated the ductile-to-brittle transition temperature (DBTT).

TABLE I

Strain-to-first crack (%) as a Function of Temperature (°F.)

| Coating/Alloy | Temperature (°F.) 1000 | 1200 | 1400 | 1600 |
|---|---|---|---|---|
| 1. Simple aluminide/ IN 738 | 0.40 | 0.55 | 1.26 | >2.1 |
| 2. Silicon-aluminide/ IN 738 | 0.31 | 0.32 | 0.58 | >2.0 |
| 3. Silicon-aluminide/ Mar-M247 | 0.23 | 0.42 | 0.52 | >1.3 |
| 4. Platinum-aluminide/ Mar-M247 | 0.34 | 0.31 | 0.54 | >1.5 |
| 5. Pt-silicon-aluminide/ Mar-M247* | 0.51 | 0.50 | 0.72 | >1.5 |

*Group B described above

The first two lines of data for samples #1 and #2 in Table I show the expected decrease in ductility as a result of the addition of silicon to a simple, unmodified diffused aluminide coating. These lines also show a somewhat higher DBTT for sample #2 as compared to sample #1, indicating that sample #2 (silicon-modified aluminide) becomes ductile only at a somewhat higher temperature. A similar ductility (line 3 in Table I) was observed for a silicon-aluminide coating on Mar-M247.

The decrease in ductility resulting from the addition of platinum to a simple diffused aluminide coating is especially evident from the data developed at 1200° and 1400° F. Sample #4 (Pt-aluminide) shows a decrease in ductility as compared to that of sample #1.

Sample #5 (made in accordance with the invention) shows an unexpected, significant improvement in coating ductility as compared to samples #2, #3 and #4. Since improvements in coating ductility on the order of 0.2 percent translate to enhanced stress bearing capability as well as enhanced thermal cycling capability of the coating, the improvement in coating ductility exhibited by sample #5 relative to samples #2, #3 and #4 is significant in a practical sense for improving performance of the coating in service. Moreover, this improvement in coating ductility of sample #5 is achieved in combination with the excellent hot corrosion/oxidation resistance demonstrated previously hereinabove.

The relative changes in coating ductility due to the addition of platinum and silicon individually and together to a simple diffused aluminide coating can be further illustrated as follows:

TABLE II

Effect of Coating Additions on Coating Ductility

| Change in Coating Composition | Change in Ductility (%) 1000° F. | 1200° F. | 1400° F. |
|---|---|---|---|
| Addition of silicon to aluminide | | | |
| IN738 Substrate | −22.5 | −41.8 | −54.0 |
| Mar-M247 Substrate | −42.5 | −23.6 | −58.7 |
| Addition of platinum to aluminide | | | |
| Mar-M247 | −15.0 | −43.6 | −57.1 |
| Addition of silicon to platinum-aluminide | | | |
| Mar-M247 | +50.0 | +38.0 | +33.3 |

The method of the invention thus provides a platinum- and silicon-enriched diffused aluminide coated superalloy substrate that not only exhibits excellent hot corrosion/oxidation resistance comparable to that of CoCrAlY overlay coatings and conventionally applied platinum- or silicon-enriched diffused aluminide coatings but also exhibits an unexpected and surprising improvement in elevated temperature coating ductility compared to conventional platinum- or silicon-enriched diffused aluminide coatings as a result of the presence of both platinum and silicon in the coating. Moreover, the method of the invention achieves these advantageous results using a process and equipment with lower cost than processes and methods used to apply CoCrAlY overlay coatings. Moreover, these advantageous results are achieved without the need for an electroplating step to deposit platinum on the substrate as heretofore used in processes to form platinum-enriched diffused aluminide coatings on superalloys. Using an electrophoretic deposition step to deposit platinum and silicon alloy powder initially on the superalloy substrate instead of an electroplating step to deposit only platinum provides numerous advantages such as the following: (1) less substrate surface preparation is required for the electrophoretic deposition step, (2) the time to effect electrophoretic deposition is less, (3) no strong acids, no corrosive vapors and no bath heating are present or required for the electrophoretic deposition step, (4) the electrophoretic bath is less sensitive to contamination by metallic ions as well as organic materials, (5) simpler, less costly anode materials are usable for the electrophoretic deposition step, (6) more uniform, self-leveling deposits are achievable with the electrophoretic step, (7) the Pt-Si alloy powder remaining in the electrophoretic bath can be reused after removal of spent solvent, washing the powder and replenishing the bath with fresh solvent, (8) the deposition of the Pt-Si alloy powder and the aluminum-bearing powder on the substrate are conducted on the same type of equipment without the need for separate plating facilities (9) simple, cheap rubber masks can be used in the electrophoretic bath, and (10) no pH adjustment of the electrophoretic bath is necessary. These and other advantages of the electrophoretic deposition step provide significant cost savings in the formation of platinum-silicon enriched diffused aluminide coatings on superalloy substrates in accordance with the method of the invention.

Although the invention has been described in terms of certain specific embodiments, it is to be understood that modifications and changes can be made thereto within the scope of the invention and appended claims.

The embodiments of the invention in which an exclusive property or privilege is claimed are defined as follows:

1. A method of forming a hot corrosion- and oxidation-resistant diffused aluminide coating of improved ductility on a nickel- or cobalt-base superalloy substrate body, comprising:

(a) electrophoretically depositing onto a said substrate a platinum-silicon powder comprising about 3 percent to about 50 percent by weight silicon and the balance essentially platinum, (b) heating the deposited platinum-silicon powder at a temperature sufficient to melt the powder into a transient liquid phase and to initiate diffusion of platinum and silicon into the substrate, (c) electrophoretically depositing an aluminum-bearing powder comprising aluminum, chromium and optionally manganese onto the platinum and silicon-enriched substrate, and (d) heating the deposited aluminum-bearing powder at a temperature and for a time sufficient to form a platinum- and silicon-enriched diffused aluminide coating on the substrate having a coating ductility at elevated temperatures greater than that of a platinum-enriched aluminide coating without silicon formed on the same substrate material.

2. The method of claim 1 wherein the platinum-silicon and/or the aluminum powder are prealloyed.

3. The method of claim 1 wherein the platinum-silicon powder comprises about 5 to 20 percent by weight silicon and the balance essentially platinum.

4. The method of claim 1 wherein the aluminum content of the aluminum-bearing powder is about 40 percent to about 75 percent by weight with the balance being chromium and optionally manganese.

5. A hot corrosion- and oxidation-resistant article comprising a nickel or cobalt superalloy substrate having a platinum- and silicon-enriched diffused aluminide coating formed thereon, said coating having a coating ductility at elevated temperatures greater than that of a platinum-enriched diffused aluminide coating without silicon formed on the same substrate material.

* * * * *